United States Patent [19]

Williams

[11] 4,058,252

[45] Nov. 15, 1977

[54] AUTOMATIC SAMPLE PROCESSING APPARATUS

[76] Inventor: Melvin Williams, 840 Elmwood, Evanston, Ill. 60202

[21] Appl. No.: 625,029

[22] Filed: Oct. 23, 1975

Related U.S. Application Data

[60] Continuation-in-part of Ser. No. 617,236, Sept. 26, 1975, abandoned, which is a continuation of Ser. No. 487,317, July 10, 1974, Pat. No. 3,908,893, which is a division of Ser. No. 351,631, April 16, 1973, Pat. No. 3,838,809.

[51] Int. Cl.[2] ..... B04B 15/02

[52] U.S. Cl. ..... 233/14 R; 233/20 R; 233/25; 233/26; 141/8; 141/34; 141/130

[58] Field of Search ..... 233/14 R, 14 A, 19 R, 233/19 A, 20 R, 20 A, 1 R, 26, 27, 21, 25; 141/8, 34, 130

[56] References Cited

U.S. PATENT DOCUMENTS

| | | | |
|---|---|---|---|
| 3,049,889 | 8/1962 | Carfagno | 233/3 |
| 3,081,158 | 3/1963 | Winter | 233/26 X |
| 3,151,073 | 9/1964 | Anthon | 233/26 X |
| 3,193,358 | 7/1965 | Baruch | 233/26 X |
| 3,475,130 | 10/1969 | Baruch | 233/26 X |
| 3,655,123 | 4/1972 | Hudson et al. | 233/21 |
| 3,706,413 | 12/1972 | Blum | 233/26 X |
| 3,885,735 | 8/1973 | Westbert | 233/25 |
| 3,902,660 | 9/1975 | Barber | 233/26 |

*Primary Examiner*—George H. Krizmanich
*Attorney, Agent, or Firm*—Merriam, Marshall & Bicknell

[57] ABSTRACT

An automatic sample preparation apparatus including a centrifuge apparatus for centrifugally separating the lighter components of a sample mixture from its heavier components and an automatic sample loading apparatus which utilizes centrifugal forces to load the sample into a centrifuge drum through an aperture in the bottom end of the drum. A separation chamber in the drum has a truncated conical interior side wall with a trap or cavity therein ringing the wall. The centrifuge drum is spun to force the heavier components into the cavity while the lighter components are forced up the conical interior side wall portion. Means are provided to remove one or both of the components from the separation chamber while the centrifuge drum is spinning to prevent the sample from pouring out of the drum through the bottom aperture. In one embodiment, one of the components is aspirated from the separation chamber by a vacuum source coupled to the interior of the chamber through the hollow shaft on which the drum is spun. Means are also provided for automatically washing sample residues from the separation chamber before subsequent samples are loaded into the chamber. In another embodiment, a plurality of the centrifuge apparatus are mounted on a circular plate rotating in step with a circular tray carrying a plurality of samples from which the samples are initially loaded into the centrifuge drums by the automatic sample loading apparatus. Another circular tray carries a plurality of containers for sequentially receiving the separated component from the centrifuge drum.

41 Claims, 11 Drawing Figures

AUTOMATIC SAMPLE PROCESSING APPARATUS

RELATED APPLICATIONS

This is a continuation-in-part application of application Ser. No. 617,236, filed Sept. 26, 1975, which is a continuation of U.S. Pat. No. 3,908,893, issued Sept. 30, 1975, on application Ser. No. 487,317, filed July 10, 1974, which is a division of U.S. Pat. No. 3,838,809, issued Oct. 1, 1974, on application Ser. No. 351,631, filed Apr. 16, 1973.

BACKGROUND OF THE INVENTION

The present invention relates generally to centrifugal separation of liquids and more particularly to an apparatus for automatically separating the serum, or plasma, from a whole blood sample for subsequent biochemical analysis.

Specific reference should be made to the following U.S. Pat. Nos. 3,049,889; 3,623,658; 1,534,604; and 736,976. Reference may also be made to the following U.S. Pat. Nos. 3,737,096; 3,722,790; 3,706,413; 3,635,394; 3,586,484; 3,439,871; 3,333,765; 3,235,173; 3,228,595; 3,211,368; 3,193,358; 3,190,547; 3,161,593; 3,151,073; 3,129,175; 2,948,462; 2,940,662; 2,906,453; 2,906,452; 2,906,451; 2,906,450; 2,822,315; 2,822,127; 2,822,126; 1,824,723; 621,706; 436,419; 360,342 and 241,172.

The modern medical research and diagnostic techniques in use today commonly rely on the analysis of blood samples. Whole blood, however, comprises a variety of immiscible components (e.g., the red cells, the white cells and the platelets) suspended in a colloidal serum, or plasma. Often, however, the analysis must be performed solely on the plasma so that the immiscible components are not present to alter or mask the characteristics to be observed.

In spite of the advent in recent years of many automatic and semiautomatic clinical chemistry analyzers, blood processing techniques have remained unchanged and time consuming. The present centrifugal separation technique commonly used for processing whole blood to serum or plasma (heparinized serum) requires the following steps:

1. collecting a whole blood sample in a test tube;
2. removing the stopper from the test tube;
3. rimming the specimen with a stirring rod;
4. "balancing" the test tube (geometrically and symmetrically) in a centrifuge;
5. centrifuging the test tube for 10 minutes at a relative centrifugal force (RCF) of 850 to 1,000;
6. decanting or aspirating the serum into a serum container; and
7. transporting the serum to an analyzer station.

While this technique is commonly used to process blood samples, it requires approximately 30 minutes to process a single sample. Thus, this technique is ill-suited for use in modern automated laboratories capable of analyzing up to 120 blood samples per hour.

"Batch" centrifuging has been utilized to process a plurality of blood samples simultaneously. However, successive batches may not contain the same number of samples, and accordingly, the centrifuge should be rebalanced after each batch to prevent vibrations which might damage the centrifuge. Moreover, the batch size (i.e., the number of samples in a batch) is limited because the plasma should be decanted or aspirated as soon as possible after the centrifuge is stopped, or the immiscible components will rediffuse into the plasma.

Accordingly, complex mechanical devices have been devised to automatically separate the serum or plasma from whole blood. However, the systems heretofore devised have generally been so mechanically complex and expensive that their use has been limited.

SUMMARY OF THE INVENTION

According to the present invention, there is provided method and apparatus for separating a sample such as blood into its lighter and heavier components. In one embodiment of the invention, means are provided for spinning a centrifuge drum to cause the heavier components and the lighter components of the sample to separate in the drum and for aspirating at least one of the components from the centrifuge drum while the drum is spinning. More particularly, the drum is mounted at the end of a hollow shaft which, in turn, is rotated about its longitudinal axis to spin the centrifuge drum. A vacuum source is coupled to the interior of the drum through the hollow shaft to aspirate the separated component from the drum. The drum itself comprises a separation chamber having a truncated conical interior side wall with a cavity ringing the interior wall to trap the heavier components while the lighter components are forced up the interior side wall. A tube having one end positioned in the chamber adjacent the juncture of the cavity and the interior side wall runs through the hollow shaft to a coupling means which couples the tube to the vacuum source to aspirate the separated component from the chamber through the tube and coupling means. The vacuum source may comprise, for example, a vacuum container such as a rubber-stoppered, vacuumized test tube into which a needle coupled to the aspiration tube is thrust, the resulting vacuum exerted on the aspiration tube causing the component to be aspirated from the drum. Means are also provided to flush a wash solution through the tube into the chamber. Valve means in the cavity permit the other separated component and the wash solution to be conveniently removed from the chamber.

The apparatus further includes an automatic sample loading apparatus for loading a sample into the separation chamber of the centrifuge drum through an aperture in its bottom end. The automatic sample loading apparatus comprises a sample container containing the sample to be loaded into the drum and means for selectively moving the centrifuge drum and the sample container into juxtaposition during loading so that the top end of the sample container engages and communicates with an aperture in the bottom end of the centrifuge drum. When the sample container is rotated by the spinning centrifuge drum, the sample flows from the sample container into the centrifuge drum.

In accordance with another aspect of the invention, a plurality of samples are simultaneously centrifugally separated into their components by an automatic sample processing apparatus comprising a plurality of the centrifuge apparatus or units mounted on a circular plate, each unit comprising a centrifuge drum and a motor for spinning the drum. The automatic loading apparatus provided sequentially loads each of the drums with one of the samples carried by a rotating circular tray as the circular plate is rotated to step the centrifuge units past the automatic loading apparatus. After centrifuging, one of the separated components is aspirated from each drum into one of a plurality of vacuum containers carried in a rotating circular sample retrieval tray.

BRIEF DESCRIPTION OF THE DRAWINGS

The features of this invention which are believed to be novel are set forth with particularity in the appended claims. The invention together with its further objects and advantages thereof, may be best understood, however, by reference to the following description taken in conjunction with the accompanying drawings, in which like reference numerals identify like elements in the several figures and in which:

DETAILED DESCRIPTION

Figure 1:
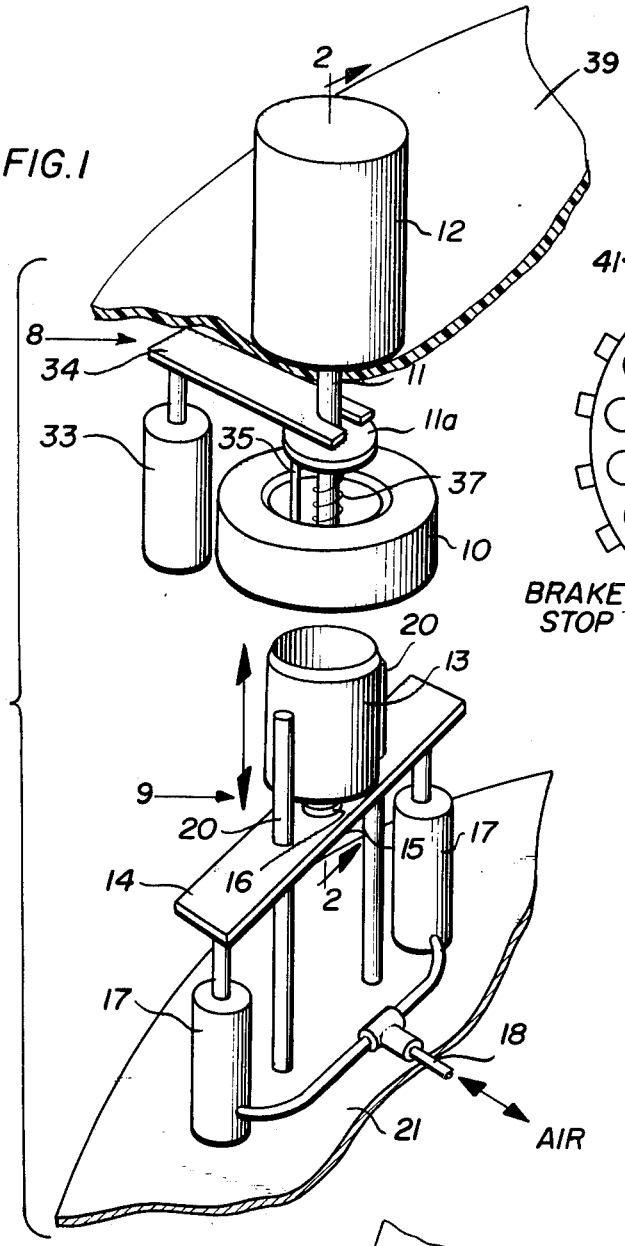
FIG. 1 is a perspective view of a centrifuge unit in accordance with one embodiment of the invention.

In accordance with one embodiment of the present invention, the centrifuge apparatus identified generally at 8 in FIG. 1 includes a centrifuge drum 10 for centrifuging whole blood to obtain plasma samples for biochemical analysis.

More particularly, the drum 10 is mounted on a shaft 11, coincident with its longitudinal axis, and rotated at high speeds by a hydraulic motor 12 mounted on a circular plate member 39 to centrifuge the blood sample, separating the packed red cells from the plasma.

A sample loading apparatus identified generally at 9 is positioned directly below the drum 10 for automatically loading the whole blood into the drum 10 for subsequent centrifugal separation. The loading apparatus comprises a substantially cylindrical cup 13 removably mounted on a horizontal plate 14 by means of a shaft 15 on the bottom of cup 13 which is insertable into an aperture in plate 14. Further, an arrangement comprising several ball bearings (not shown) mounted in an annular sleeve 16 is interposed between plate 14 and the bottom of cup 13. Accordingly, cup 13 is free to spin about its longitudinal axis (i.e., shaft 15). Moreover, the longitudinal axis of cup 13 is aligned with the rotational axis (i.e., shaft 11) of centrifuge drum 10.

Figure 2:
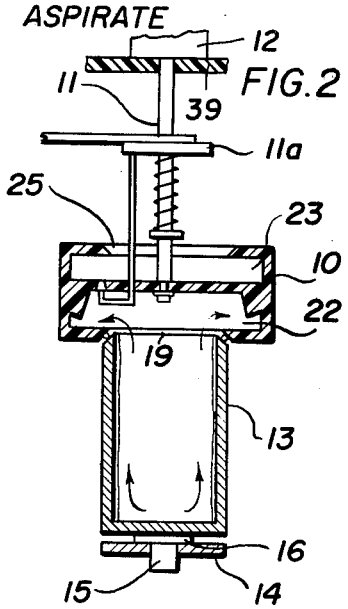
FIG. 2 is a sectional view of the centrifuge unit taken along lines 2—2 of FIG. 1 illustrating a method of loading a sample into the centrifuge drum of the centrifuge unit.

A pair of air cylinders 17, positioned at opposite ends of plate 14, are effective to vertically reposition plate 14 relative to the bottom of centrifuge drum 10 whenever compressed air is introduced, or released as the case may be, into the cylinders through tubing 18. Consequently, cup 13 can be moved along its longitudinal axis until its open top end is coincident, or in juxtaposition, with a corresponding aperture 19 (FIG. 2) in the bottom end of centrifuge drum 10.

Operationally, the blood sample is initially placed in cup 13 for subsequent loading into the centrifuge drum 10. The automatic loading feature of the present invention may be more readily understood by reference now to FIG. 2. Once the sample is placed therein, cup 13 is repositioned so that its open end is in juxtaposition with the aperture 19 in the bottom of drum 10. The top edge of cup 13 is beveled to fit the correspondingly beveled edge of aperture 19. Consequently, when the centrifuge drum is rotated while in juxtaposition with cup 13, the cup 13 is also rotated. A pair of alignment bars 20 (FIG. 1) extend from base 21 and pass through corresponding apertures in plate 14 to prevent twisting.

When the drum 10 and the cup 13 are rotated at high speed about their common axis, the blood sample is subjected to powerful centrifugal forces which displace the blood, pressing it against the cylindrical wall of cup 13. Consequently, the blood is also subjected to lateral forces resulting from the pressure developed between the blood sample and the wall. Accordingly, the sample, in effect, flows up the cylindrical wall and into the centrifuge drum 10. Thus, when drum 10 reaches a certain rotational speed, the entire sample, for all practical purposes, is loaded therein. While still spinning, the cup 13 is then "dropped away" from aperture 14 by the loading apparatus. Because drum 10 is still spinning, however, the blood sample is pressed against the drum's interior wall so that it cannot escape through aperture 19.

Figure 3:
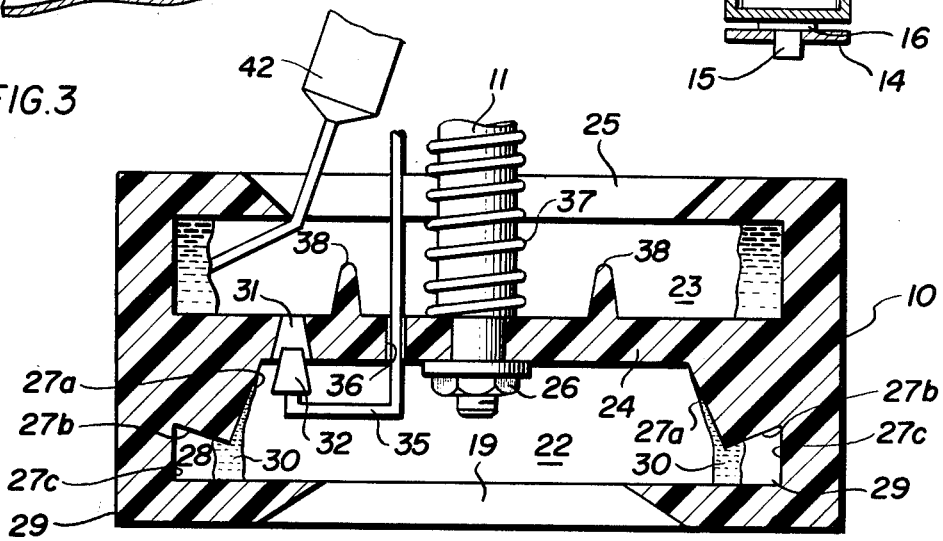
FIG. 3 is a detailed sectional view of the centrifuge drum taken along lines 2—2 of FIG. 1.

The interior features of the centrifuge drum 10 are shown in FIG. 3. There, it may be seen that the centrifuge drum 10 is divided into a pair of adjacent chambers, a separation chamber identified generally at 22 and an aspiration chamber identified generally at 23, separated by a common wall 24. In addition to aperture 19 in the bottom of separation chamber 22, a similar aperture 25 is provided in the top end of the aspiration, or pick-up, chamber 23. Thus, the shaft 11 is passed through aperture 25 and is attached to the center of common wall 24 by a suitable fastening arrangement 26.

The interior wall 27 of separation chamber 22 comprises three essentially distinct sections: 27*a* defining a truncated conical portion while 27*b* and 27*c* define a larger diameter trap portion, identified generally at 28, located at its base. During loading, the blood is initially forced into the trap portion 28 where the heavier immiscible cellular components 29 are trapped. Even when the volume of blood loaded into the separation chamber 22 exceeds the volume of trap portion 28, the packed red cells are captured in the trap 28 while the lighter plasma forms a distinct layer 30 interior to the packed red cells. By loading a precise amount of blood into the separation chamber 22, it is insured the volume of trap 28 is sufficient to contain the entire volume of packed red cells in the sample. Consequently, the same lateral forces resulting from centrifugation that were utilized to load the sample into the separation chamber 22 will prevail to force the plasma up the conical wall portion 27*a* toward the aspiration chamber 23.

As previously mentioned, the separation chamber 22 and the aspiration chamber 23 are separated by a common wall 24. However, a valve orifice 31 is provided in wall 24 to connect the two chambers at a point near the juncture of the conical wall portion 27*a* and the common wall 24. During centrifuging, therefore, the plasma is forced into the aspiration chamber 23 while the heavy blood cells are retained in the trap portion 28. At all other times, the orifice 31 is closed by a valve plug 32 insertable therein. Thus, if the centrifuge drum 10 is stopped, the plasma cannot flow back into the separation chamber 22 through orifice 31.

More particularly, at a predetermined time during centrifuging, a trigger mechanism, comprising air cylinder 33, bar 34, plate 11*a*, and L-shaped rod 35 (FIG. 1) combine to remove the plug 32 from the orifice 31. In operation, the air cylinder 33, controlled by an influx of compressed air, forces bar 34 downward. The L-shaped rod 35, which is secured to the plate 11*a* rotating with shaft 11, passes through a guide slot 36 in the common wall 24 and, in turn, is effective to disengage the plug 32 when the bar 34 pushes plate 11*a* downward on shaft 11. Subsequently, when the trigger mechanism (i.e., air cylinder 33) is released just prior to the end of centrifuging, a spring 37 on shaft 11 forces the bar 34 upward so that plug 32 seals the orifice 31, permanently separating the plasma from the packed red cells. Accordingly, when the centrifuge drum 10 stops spinning, the plasma may be manually or automatically aspirated from the pick-up chamber 23 through the aperture 25. A barrier 38 is also provided to contain the plasma within a limited area of the base of aspiration chamber 23 after the drum 10 stops spinning so that the plasma may be more easily aspirated.

Figure 4:
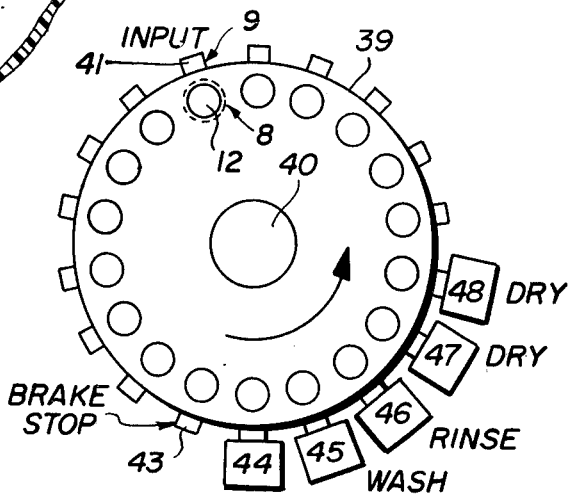
FIG. 4 is a schematic representation of an automatic serum preparation apparatus utilizing a plurality of the centrifuge units shown in FIG. 1.

The centrifuge unit of the present invention is especially well suited for adaptation to provide an automatic serum preparation apparatus, such as that shown schematically in FIG. 4. That is, because each centrifuge unit is virtually independent of the other units, several units may be combined to provide an automatic serum preparation unit for simultaneously processing several blood samples.

As shown in FIG. 4, a number of centrifuge units 8 (e.g., 18) are mounted on a conveyor such as the circular plate 39 shown in FIG. 1 which may be approximately 16 inches in diameter. The plate 39, in turn, is sequentially rotated at a predetermined rate to various positions, or stations, by a stepping motor 40. At input station 41, a centrifuge unit 8 is centered over an automatic loading mechanism 9 so that the cup containing the whole blood can be raised into juxtaposition with the centrifuge drum. Subsequently, the centrifuge motor 12 spins the drum and the cup in the manner previously described, causing the sample to be loaded into the drum. Once the whole blood is loaded, the cup is dropped away, and the stepping motor 40 advances the plate 39, moving centrifuge unit 8 to the next station. Accordingly, blood samples can be introduced into successive centrifuge units at an input station 41 by loading the sample into a unit and advancing the plate 39 so that the loaded unit is replaced by an empty unit.

As the centrifuge 8 is advanced, the plasma and packed red cells are separated, and the plasma is isolated in the aspiration chamber of the drum. Subsequently, the centrifuge unit 8 reaches "brake stop" station 43 where the spinning drum is stopped. The stepping motor 40 next advances the unit 8 to the "aspirate" station 44 where aspiration of the plasma may be effected through aperture 25 by means of a syringe 42 operated manually or automatically. The centrifuge unit 8 is then moved to the "wash" station 45 where a soap solution is sprayed into both chambers of the drums, cleaning both of all traces of the blood sample. In turn, the unit 8 is advanced to the "rinse" station 46 where both chambers are thoroughly rinsed, and finally, it is stepped through two successive "dry" stations 47 and 48 where the centrifuge drum is dried. After completion of this sequence, the centrifuge unit 8, as well as successive cenrifuge units, is ready to centrifuge a new sample, and thus, when it once again reaches input station 41, it is loaded with a new blood sample.

Accordingly, the automatic loading centrifuge unit just described is adaptable for use in a "batch" processing automatic serum preparation arrangement. Because the plasma, or serum, is automatically separated from the whole blood and isolated in a pick-up chamber where the packed red cells cannot recombine with the plasma, there is less urgency for removing the plasma from the centrifuge. Further, less care need be taken in aspirating the plasma since only the plasma is separated into the pick-up chamber. If that were not the case, as in prior art systems, care would have to be exercised to insure that the end of the aspirating needle is not inserted too deeply into the plasma layer, aspirating the immiscible components as well as the plasma. Finally, the unit's relatively simple design maintains the cost of each unit at a minimal level, making it extremely attractive for use in hospitals and research laboratories.

Figure 5:
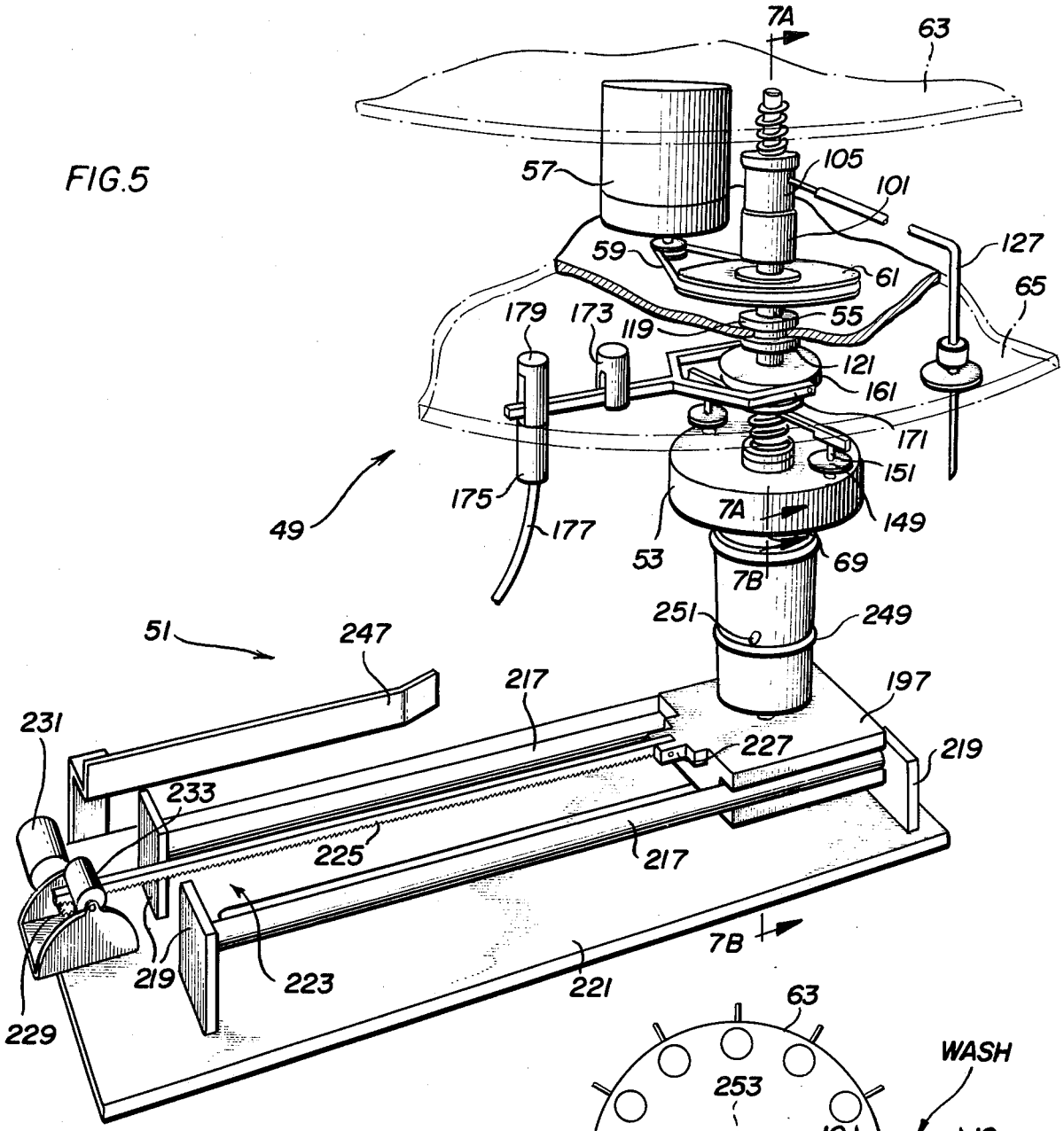
FIG. 5 is a perspective view of a centrifuge apparatus and an automatic loading apparatus in accordance with an alternative embodiment of the invention.
Figures 6, 10:
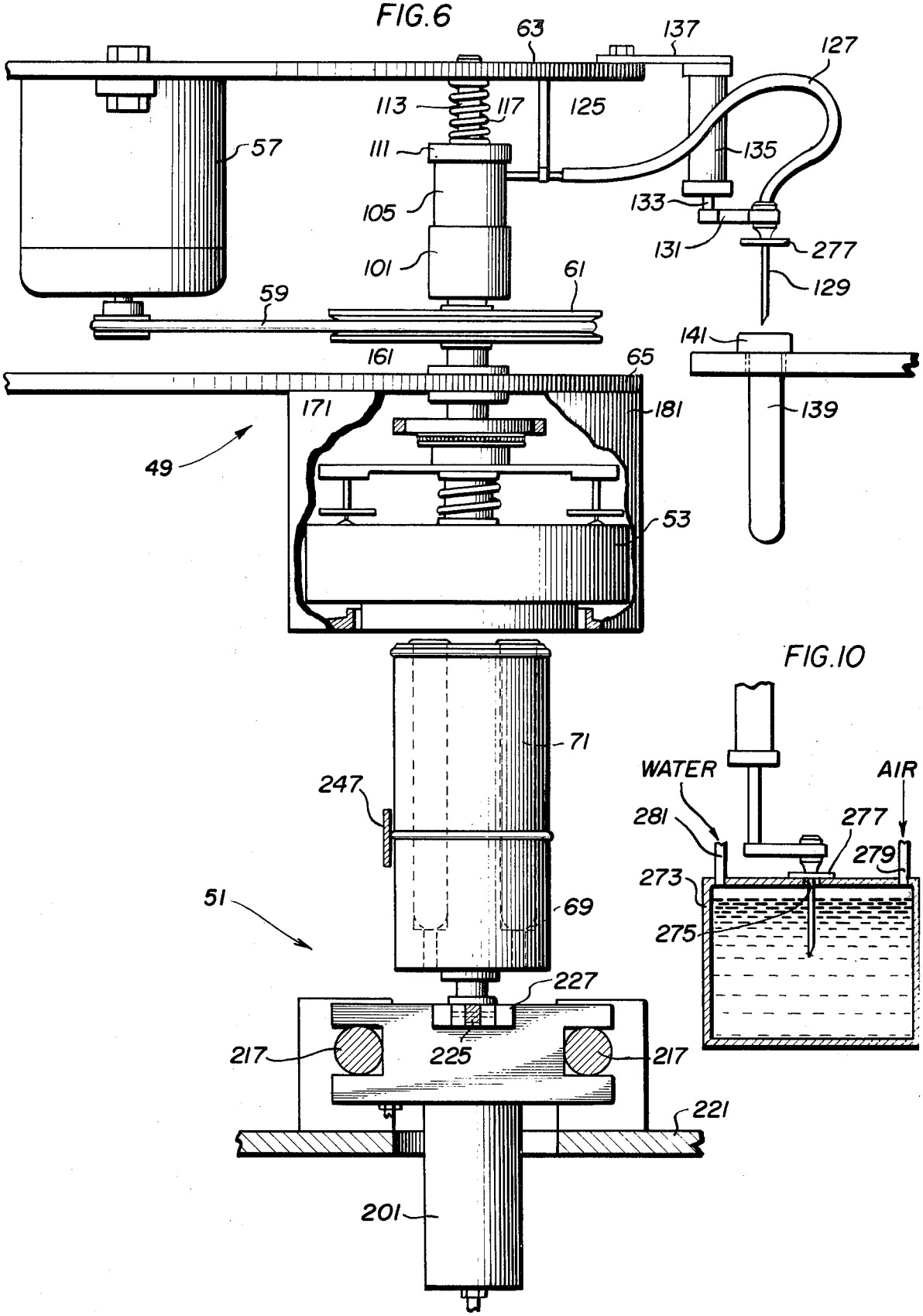
FIG. 6 is an elevational view of the centrifuge apparatus and automatic loading apparatus shown in FIG. 5.
FIG. 10 is a sectional view of the washing apparatus taken along lines 10—10 of FIG. 8.

An alternative embodiment of the automatic sample preparation apparatus and alternative embodiments of the centrifuge apparatus and the automatic sample loading apparatus, are shown in FIGS. 5–10, inclusive, and hereinafter described in greater detail. Referring generally to FIGS. 5 and 6, the centrifuge apparatus and the automatic loading apparatus are identified generally at 49 and 51, respectively. The centrifuge apparatus basically comprises a cylindrical centrifuge drum 53 mounted on the bottom end of a rotatable shaft 55. The drum 53 is spun at high speed about its longitudinal axis which is common with the longitudinal axis of shaft 55 by a motor 57 coupled by a belt 59 to a belt-driven pulley 61 on shaft 55, resulting in the separation of the sample into its lighter and heavier components in the drum 53. The motor 57 is affixed, e.g., bolted, to the bottom side of a circular plate member 63 while the shaft 55 is supported by and extends through a second circular plate member 65 lying in a horizontal parallel plane directly below plate 63.

The automatic sample loading apparatus facilitates the automatic loading of a sample into the centrifuge drum 53 and comprises a sample container 67 which can be vertically repositioned to engage and communicate with the centrifuge drum 53 from below. The sample container 67 takes the form of a solid cylindrical block having a pair of holes 69 therein for accommodating one or two sample containing tubes 71. Accordingly, whenever the sample container 67 engages the drum 53 and the motor 57 is operative to spin the centrifuge drum 53, the sample container 67 is correspondingly spun about its longitudinal axis which is aligned with the common longitudinal axis of the drum 53 and the shaft 55. The sample tubes 71, however, are positioned some distance away from the longitudinal axis to provide adequate centrifugal force sufficient to cause the sample to climb the tube walls and enter the centrifuge drum 53. Once the sample is loaded into the drum 53, the sample container 67 is lowered away from the drum 53 even as the drum is rotating to prevent the sample from draining out of the drum 53.

Figure 7A:
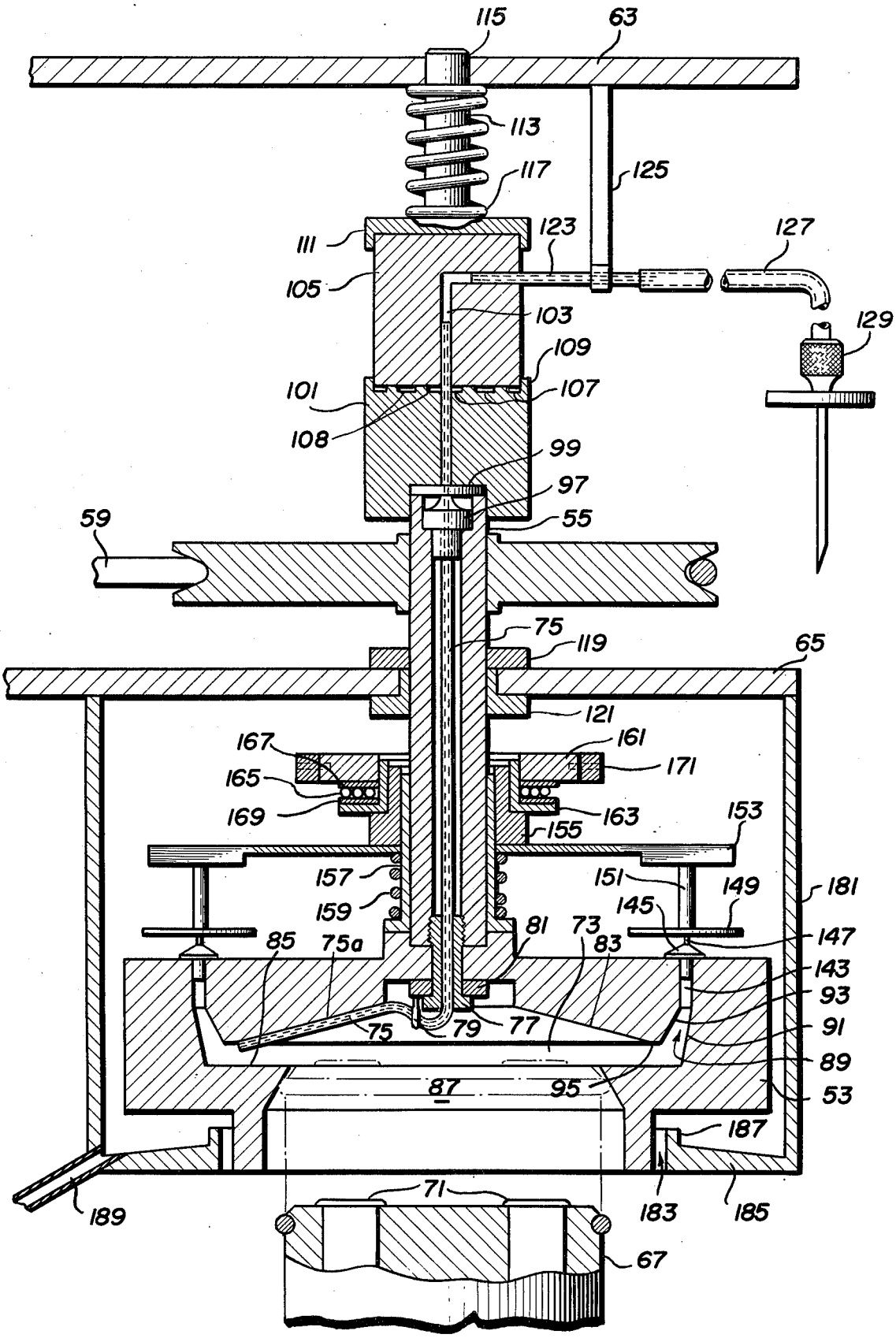
FIG. 7A is a sectional view of the centrifuge apparatus taken along lines 7—7 in FIG. 5.

With particular reference now also to FIG. 7A, it will be apparent that the interior of the centrifuge drum 53 comprises a single chamber, separation chamber 73. Unlike the first embodiment, no aspiration chamber is required nor is one provided. Rather, in accordance with one aspect of the present invention, one of the separated components, e.g., the lighter plasma component, is aspirated directly from the separation chamber 73 by means of an aspiration tube 75 coupled to a vacuum source and extending down through the hollow center of shaft 55 into the aspiration chamber 73. When the vacuum source is coupled to the upper end of the aspiration tube 75, the lighter plasma component is automatically aspirated directly from the separation chamber 73 while the drum 53 is rotating.

More particularly, the centrifuge drum 53 is mounted on the bottom end of the shaft 55 by a threaded bolt 77 engaging a threaded section **77*a* at the bottom end of the hollow interior of shaft 55. The aspiration tube 75 passes from inside the shaft 55 to the interior of the separation chamber 73 via a tubular passage through the center of the bolt 77 from end to end. In the separation chamber 73, the aspiration tube 75 is directed through an eyelet 79 affixed to the bottom side of a washer 81 placed between the bolt 77 and the flat upper interior surface of the separation chamber 73. The aspiration tube 75 is directed upwardly by the eyelet 79 to engage a groove 75*a* in a truncated conical interior side wall 83 which directs the tube 75 to a point near the bottom edge of the conical interior side wall portion 83. Thus, the aspiration tube 75 should be flexible enough to be directed through the eyelet 79 but sufficiently inflexible to remain in the groove 75*a* and not drop from the wall 83**, e.g., a tube made of Teflon.

The interior of the separation chamber 73 is substantially defined by a bottom end wall 85 having an aperture therein, identified generally at 87, by the truncated conical interior side wall portion 83 and by a cavity or trap portion, identified generally at 89, located in the present embodiment, for example, at the bottom edge of the interior side wall 83. The cavity 89 comprises an outer wall 91 and an inner wall 93 joined to the truncated conical interior side wall 83 by a connecting wall 95. It has been experimentally determined for a blood sample of 5–7 cc., for example, that the optimum dimension of the inner wall 93 is 3/16 inch and ¼ inch for the outer wall 91 and the connecting wall 95. The optimum distance between the connecting wall 95 and the bottom end wall 85 is 1/16 inch. Further, the conical interior side wall 83 should be sloped at an angle of approximately 15° with respect to horizontal. In the present embodiment, the outer wall 91 is angled slightly outwardly and the cavity 89 has an exaggerated upper portion when compared with the trap portion of the first embodiment to provide greater separation between the lighter and heavier components in the separation chamber 73. Accordingly, the approximately 3½ cc. of heavy components will be contained in the cavity 89 along with a smaller portion of the lighter components, e.g., plasma, the small amount of lighter components in the cavity 89 insulating the heavier components from the end of the aspiration tube 75 which is located at the base of the interior side wall 83 near the connecting wall 95. Thus, only the lighter components are aspirated from the separation chamber 73.

At the top end of shaft 55, the aspiration tube 75 is coupled to a needle 97 extending upward through an aperture in a cover 99 capping the end of the shaft 55. A seating member 101 having a cylindrical recess in its bottom side for accommodating the upper end of shaft 55 is affixed to the shaft 55 and rotates with it. The needle 97 extends upwardly through an orifice in the rotating seating member 101 and out the top end thereof to communicate with and be contained in the vertical portion of right-angled tubular orifice 103 in a stationary coupling block 105 supported by the rotating seating member 101. The amount of friction between the rotating seating member 101 and the stationary coupling member 105 should be minimized, and accordingly, in the present embodiment, the coupling member 105 is made of Teflon or the like thereby, in addition, minimizing the friction between the rotating needle 97 and the orifice 103. The top surface of the rotating seating member 101 has a series of concentric grooves 107 therein to further reduce the friction between the stationary block 105 and the rotating seating member 101. In addition, a lubricant 108 such as silicone grease may be applied to the upper grooved surface of the seating member 101 to further reduce friction. The outer rim 109 of the seating member 101 prevents the horizontal displacement of the stationary block 105 from its desired position while a cap 111 having a stem 113 extending through an aperture 115 in the circular plate member 63 is biased against the top surface of the stationary coupling block 105 by a spring 117. A ring 119 and a collar 121 affixed to the shaft 55 support the shaft 55 on the top surface of the second circular plate member 65 and permit the shaft 55 to rotate.

A metal tube 123 is inserted into the horizontal portion of the right-angled tubular orifice 103 in the coupling member 105 and held in position by a support member 125 extending downwardly from and affixed to the bottom surface of the top plate member 63. The support member 125 is effective to prevent the rotation of the coupling block 105. One end of a flexible tube 127 of a material, for example, such as Teflon, communicates with the end of the metal tube 123 while its other end is coupled to a needle 129. As illustrated in FIG. 6, the needle 129 is supported by an arm 131 attached to the end of the piston rod 133 of a pneumatic cylinder 135 which, in turn, is coupled to the plate member 63 by a support member 137. The pneumatic cylinder 135 is selectively actuable to raise and lower the needle 129 in the vertical direction to selectively engage and disengage a vacuum container 139, the needle 129 puncturing a rubber stopper 141 capping the vacuum container 139. Operationally, after the sample is located into the separation chamber 73 and the lighter and heavier components have been separated by spinning the centrifuge drum 53, the pneumatic cylinder 135 is actuated to force the needle 129 into the vacuum container 139. The resultant vacuum exerted by vacuum container 139 on the tubular means extending through the hollow center of the shaft 55 and into the separation chamber 73 results in the aspiration, for example, of the lighter plasma components from the separation chamber 73 into the vacuum container 139 while the centrifuge drum 53 continues to spin.

Before a new sample can be introduced into the centrifuge drum 53, the heavier components and the portion of the lighter components remaining in the separation chamber 73 from the previous sample must be evacuated therefrom. Accordingly, as shown in FIG. 7A, a pair of valve orifices 143 on diametrically opposite sides of the drum 53 extend from the top of the cavity 89 to the top surface of the drum 53. A valve 145 caps each orifice 143 and is selectively actuable by depression of the valve stem 147 to couple the cavity 89 to the exterior of the drum 53. By way of example, valve 145 may comprise the ordinary tire stem valve commonly known and available to the public. Of course, any other suitable valve could be substituted. Accordingly, while the drum is spinning and after most of the lighter components have been aspirated from the separation chamber 73, the valves 145 are opened to allow the remaining components to flow upwardly from the cavity 89 and out of the centrifuge drum 53.

The valve actuating apparatus comprises a pair of flat discs 149 respectively coupled by corresponding rods 151 to the bottom side of a pair of valve actuating arms 153, each aligned to be over a corresponding one of the valves 145. The actuating arms 153, in turn, extend from and are attached to a collar 155 encircling the shaft 55. A sleeve 157 is interposed between the collar 155 and the shaft 55 to provide a sliding surface for the collar 155. A spring 159 is positioned between the bottom edge of the collar 155 and a flange extending outwardly from the sleeve 157 to normally bias the valve actuating arms 153, and hence the discs 149, away from the valves 145. The valve actuating apparatus is selectively depressed to open the valves 145 by applying a downward force to a non-rotating ring 161 which is supported on a collar 163, in turn, resting on collar 155. A ball bearing ring 165 is positioned between an upper race 167 and a lower race 169 to permit the remainder of valve actuating apparatus to rotate with the shaft 55 and the centrifuge drum 53 while the ring 161 remains stationary. The downward force is applied to the ring 161 through a yoke 171 coupled to the ring 161. Referring briefly to FIG. 5, in particular, the yoke 171 is pivoted at an intermediate point along its length by support member 173 depending from the plate 65 so that an upward force applied to its free end is translated into a downward force applied to the ring 161, the upward force being supplied by a pneumatic cylinder 175. That is, compressed air is selectively coupled to the cylinder 175 through an air hose 177 to actuate the pneumatic cylinder 175 to raise the free end of the yoke 171 in a guide member 179 affixed to the bottom surface of plate 65 and on which the pneumatic cylinder 175 is mounted.

An enclosure 181 depends from the bottom surface of the second plate member 65 to surround the centrifuge drum 53 and the valve actuating apparatus to collect the components released from the centrifuge drum 53 when the valves 145 are opened. The enclosure 181 thus minimizes the spraying of the remaining sample components on the other apparatus during the cleaning of the separation chamber 73. In FIG. 7A it can be seen that an aperture 183 in the bottom wall 185 of the enclosure 181 permits the loading of the centrifuge drum 53 from below by the sample container 67. A flange 187 extends upwardly from the bottom wall 185 of the enclosure 181 to effectively prevent any of the sample from escaping through the aperture 183 in the enclosure 181 while the interior surface of the bottom wall 185 is sloped so that the remaining sample collected drains out of the enclosure 181 through a spout 189 adjacent the bottom edge of the enclosure 181.

Figures 7B, 9:
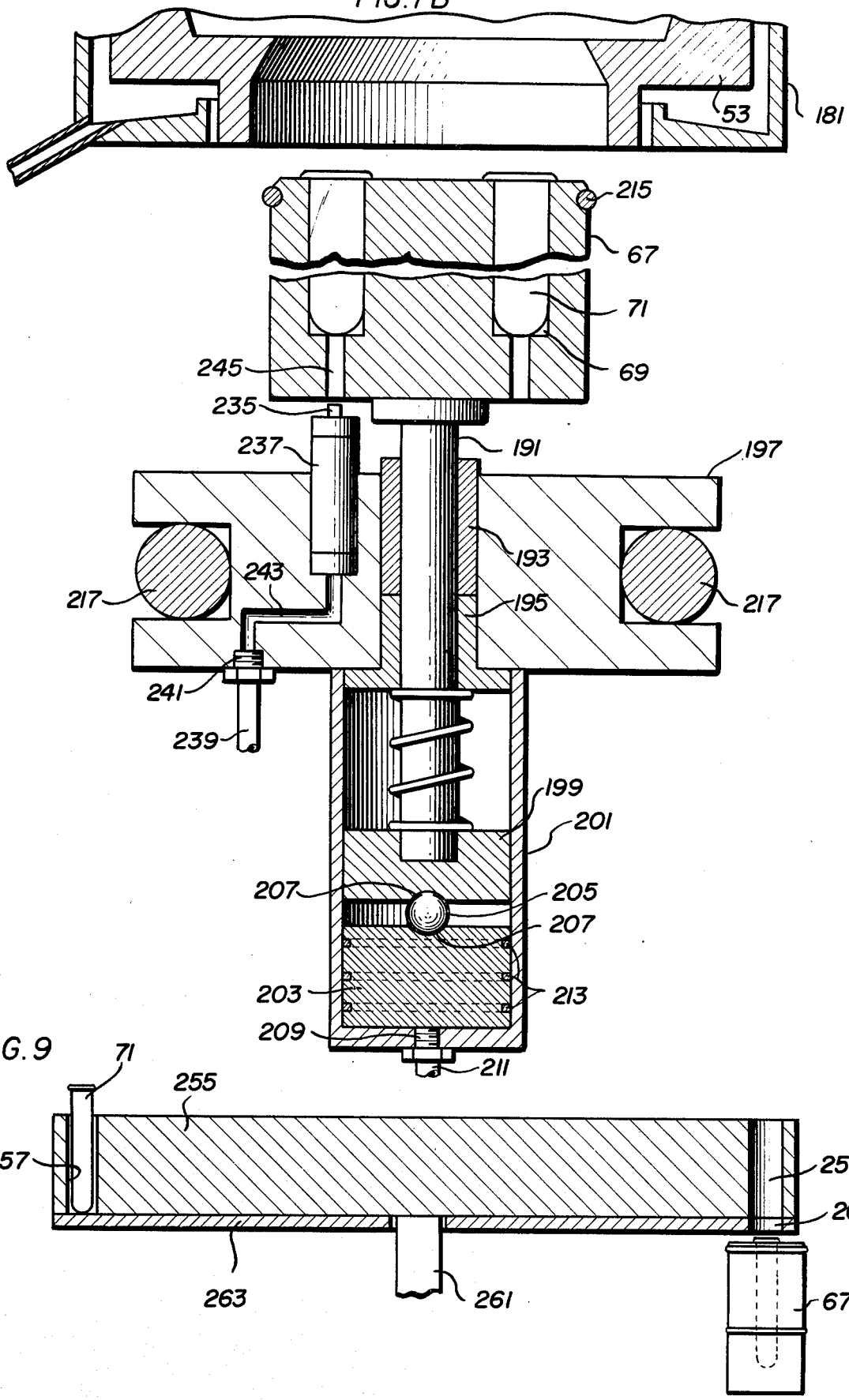
FIG. 7B is a sectional view of the automatic loading apparatus taken along lines 7—7 in FIG. 5.
FIG. 9 is a sectional view taken along lines 9—9 in FIG. 8 further illustrating the automatic sample processing apparatus.

With particular reference to FIG. 7B and general reference to FIGS. 5 and 6, the automatic sample loading apparatus is hereinafter described in greater detail. As previously described, the sample container 67 comprises a solid cylindrical block having a pair of holes 69 therein for holding a pair sample tubes 71 on diametrically opposite sides of the longitudinal axis of the container 67. Generally speaking, only one sample tube 71 will actually contain the sample to be separated while the other tube 71 is weighted appropriately to balance the sample container 67 to prevent undesirable vibrations during the loading operation. Alternatively, the weighted tube 71 can be replaced by any suitable weighted object or device.

The sample container 67 is itself mounted on the upper end of a rotatable shaft 191. A bearing comprising a sleeve 193 and a collar 195 encompasses but is not attached to the shaft 191 where it extends through a platform 197, permitting the shaft 191, and hence sample container 67, to be moved vertically as well as to rotate. The shaft 191 is seated in a cylindrical recess in the upper surface of a cylindrical block 199 which is vertically repositionable within a closed cylindrical housing 201 attached to the bottom surface of the platform 197. The cylindrical block 199 is, in turn, supported on a piston 203 by a ball bearing 205 residing in corresponding nearly semi-spherical indentations 207 in the piston 203 and the cylindrical block 199, the ball bearing 205 permitting the cylindrical block 199 to rotate even though the piston 203 does not rotate. The piston 203 is vertically repositionable within the cylinder housing 201 by compressed air introduced into the cylinder 201 through an air inlet 209 coupling the cylinder 201 to compressed air source through an air hose 211. A plurality of O-rings 213 encircle the piston 203 and ride in corresponding grooves therein to maintain an airtight seal with the wall of the cylinder 201. Accordingly, during the loading operation, compressed air is introduced into the cylinder 201 to force the piston 203 upward until the sample container 67 engages and communicates with the aperture 87 in the bottom end wall 85 of the separation chamber 73. The wall of the aperture 87 in the centrifuge drum 53 is beveled so that when the sample container 67 is vertically repositioned during loading to engage and communicate with the aperture 87, an O-ring 215 encircling the sample container 67 near its top edge engages the beveled edge to provide a seal between the sample container 67 and the centrifuge drum 53. The O-ring 215 preferably comprises a rubber-like material to provide sufficient friction between the sample container 67 and the drum 53 so that when the motor 57 is operative to spin the centrifuge drum 53, the sample container 67 is correspondingly spun about their common longitudinal axis.

As illustrated in FIG. 5, the platform 197 is slidably supported by a pair of rails 217, in turn, supported at each end by a vertical support member 219 mounted on a frame 221. The platform 197 is moved in the horizontal direction between an initial position, identified generally at 223, and the loading position under the centrifuge apparatus 49 through the combined action of a motor-driven rack and pinion arrangement. In particular, the rack gear 225 is attached to a coupling member 227 on the platform 197 and a pinion gear 229 is mounted at the far end of the frame 221 and driven by a reversible motor 231. The reversible motor 231 is actuable to selectively drive the platform 197 in either direction along the rails 217. A cylinder 233 positioned above the rack 225 insures that the teeth of the rack 225 engage the teeth of the pinion 229.

After the sample has been loaded from the sample tube 71 in container 67 into the separation chamber 73, the tube 71 is ejected from the sample container 67, as illustrated in FIG. 7B, by the piston rod 235 of a pneumatic cylinder 237 carried by platform 197. Air from a compressed air source is introduced into the pneumatic cylinder 237 through an air hose 239 coupled to an air inlet 241 in the bottom surface of the platform 197 and connected to the pneumatic cylinder 237 by a connecting air duct 243. Accordingly, to eject the tube 71, the pneumatic cylinder 237 is selectively actuated by the compressed air source so that the piston rod 235 moves upward through an orifice 245 in the bottom of the sample container 67 to push the sample tube 71 from its hole 69. In order to insure that the piston rod 235 is aligned with the orifice 245 each time a tube 71 is to be ejected, a rail 247 is provided adjacent one of the rods 217 to engage a rubber O-ring 249 encircling the sample container 67 at an intermediate point along its side. The sample container 67 is rotated by the engagement of the O-ring 249 with the rail 247 as the platform 197 is moved to the initial position 223 until a protruding member 251 extending from the side of sample container 67 engages the rail 247 to prevent further rotation of the container 67. Thus, at a predetermined point in its travel along the rail 247, the sample container 67 stops rotating and is finally positioned with its orifice 245 directly over the pneumatic cylinder 237. At or subsequent to that point on its way back to the initial position 223, the pneumatic cylinder 237 is enabled and the sample tube 71 is ejected from the sample container 67.

Figure 8:
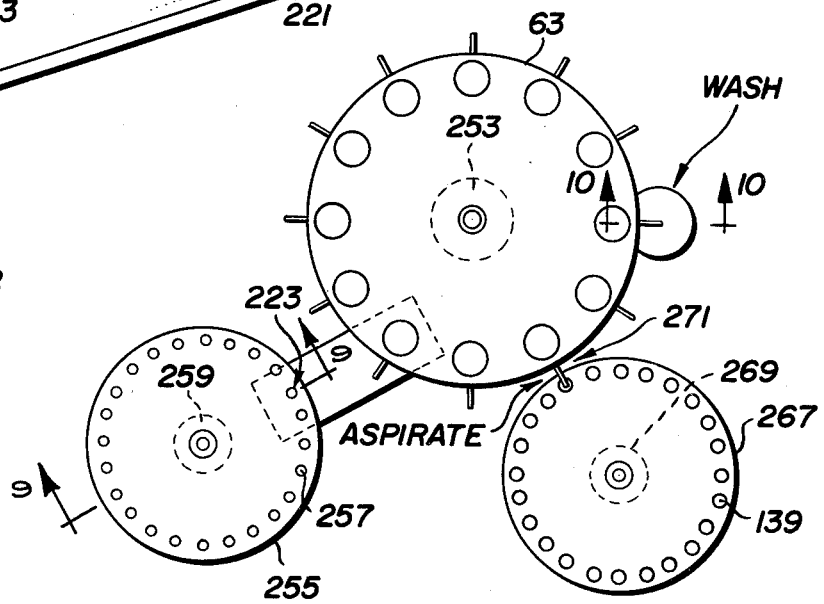
FIG. 8 is a top plan schematic representation of automatic sample processing apparatus incorporating a plurality of the centrifuge apparatus and the automatic loading apparatus shown in FIG. 5 and further including apparatus for washing the centrifuge apparatus.

Referring now to FIG. 8, there is shown an automatic sample processing apparatus in accordance with another aspect of the present invention. The apparatus comprises a plurality of centrifuge apparatus 49 arranged in a circle near the edge of a circular centrifuge transport plate member 63. A stepping motor 253 is provided to rotate the plate member 63 in a stop-and-go or stepped fashion so that each centrifuge apparatus 49 is stepped to and pauses at the automatic loading apparatus 51 in sequence. As illustrated schematically in FIG. 8, one end of the automatic loading apparatus 51 is positioned under the centrifuge apparatus 49 at one end while the other end is under a circular tray 255.

The circular tray 255 has a plurality of holes 257 along its outer rim for containing a corresponding plurality of sample tubes 71 therein. In particular, the sample tubes 71 may be manually placed in the tray 255 which is automatically rotated by a stepping motor 259 in synchronism with the circular plate member 63. At a position immediately over the automatic loading apparatus 51 corresponding to the initial position 223 of the loading apparatus 51 in FIG. 5, the sample tubes 71 are sequentially loaded into the sample container 67. That is, during the time that a particular centrifuge apparatus 49 is advanced to the automatic loading apparatus 51 from the immediately preceding position or station, a corresponding sample containing tube 71 is loaded into the sample container 67 and transported by platform 197 to the position immediately under the centrifuge apparatus 49. As previously described, once the sample tube 71 is located under the centrifuge apparatus 49, the sample container 67 is raised to engage and communicate with the aperture 87 in the separation chamber 73. The spinning of the centrifuge drum 53 by motor 57 results in the rotation of the sample container 67 and the resultant centrifugal forces cause the sample to flow up the side of the sample tubes 71 into the separation chamber 73. After loading, the sample container 67 is disengaged and the sample is centrifuged into its lighter and heavier components.

The loading of the sample tube 71 into the sample container 67 may be better understood by reference now to FIG. 9 where it can be seen that the circular tray 255 is mounted on a shaft 261 driven by the stepping motor 259. To prevent the tubes 71 from falling through the holes 257 in the tray 255, a bottom plate 263 is positioned directly under the rotating circular tray 255. The bottom plate 263 has a single aperture 265 which is aligned to be over the hole 69 in the sample container 67 when the platform 197 is moved to the initial position 223 and sample container 67 is directly under the tray 255. Accordingly, when the tray 255 is rotated, the sample tube 71 contained in the next hole 257 adjacent to the aperture 265 is advanced to be directly over the aperture 265, and the sample tube 71 falls through the hole 265 into the sample container 67. Accordingly, the platform 197 is continuously shuttled between the circular tray 255 and the circular centrifuge transport plate member 63 to automatically provide a continuous source of samples to the several centrifuge apparatus 49.

Referring again to FIG. 8, after receiving a sample, the centrifuge apparatus 49 is spun to separate the lighter components from the heavier components of the sample as the centrifuge apparatus 49 itself is stepped from the automatic loading apparatus 51. At some point along the rotation of the transport plate member 63, the separation is complete and the lighter components, for example, are aspirated from the separation chamber 73 while the drum 53 is still spinning.

A circular sample retrieval tray 267 carrying a plurality of the vacuum containers 139 in a circular arrangement near its edge is stepped in synchronism with the circular centrifuge transport plate member 63 and the circular tray 255 by a stepping motor 269. Referring also to FIG. 6 as well as FIG. 8, the flexible tube 127 and the needle 129 extend from the centrifuge apparatus 49 and at the aspiration station, identified generally at 271, the pneumatic cylinder 135 is enabled to force the needle 129 through the stopper 141 in the vacuum container 139 then at the aspiration station 271. Again, the resulting vacuum on the aspiration line 75 to the interior of the separation chamber 73 results in the aspiration of the lighter components from the separation chamber 73 into the vacuum container 139. After aspiration, the pneumatic cylinder 135 withdraws the needle 129 from the vacuum container 139 and all three trays 63, 255, and 267 are stepped forward one position.

At some point after aspiration of the sample from the separation chamber 73, the centrifuge apparatus 49 is advanced to a wash station or vessel 273 where the remaining sample components are discharged from the drum 53. There, the pneumatic cylinder 135 is again enabled, driving the needle 129 downward to enter an aperture 275 in the top of the washing vessel 273. A rubber stopper 277 carried by needle 129 contacts the upper surface of the washing vessel 273 to provide an air-tight seal. Subsequently, air is forced into the washing vessel 273 through an air inlet 279, causing the water or washing solution contained therein to be forced up through the needle 129 and the tubular aspiration means comprising the flexible tube 127, the metal tube 123, the right-angled tubular orifice 103, the needle 97, and the tube 75, in reverse fashion to wash any traces of the previous sample and all other contaminants therefrom. The wash solution is discharged from the aspiration tube 75 into the separation chamber 73 where the continued spinning of the centrifuge drum 53 forces the remaining sample components and the wash solution out of the chamber 73 through the valves 145 in the cavity 89 thereby cleaning the interior of the separation chamber 73. Thereafter, before the centrifuge apparatus 49 is stepped to the next position, the pneumatic cylinder 135 withdraws the needle 129 from the washing vessel 273 and additional water or washing solution is introduced into the vessel 273 through an inlet valve 281 in preparation for the next centrifuge drum. As the centrifuge apparatus 49 is stepped back to the initial loading position 223, the drum may continue to be rotated to dry the separation chamber 73. Accordingly, the centrifuge apparatus 49 is then prepared to receive a new sample from automatic loading apparatus 51 and continue on in the automatic processing of the samples.

Thus, the automatic sample processing apparatus just described permits the automatic processing of a sample such as blood into its lighter and heavier components from input to output without manual intervention. That is, the automatic sample loading apparatus with its provision for shuttling the sample tubes from a tray to the centrifuge apparatus and sequentially loading the samples into centrifuge drums together with the direct aspiration of the separated components from the centrifuge drums to a sample retrieval tray and the simplified mode of washing the drums eliminates entirely any manual steps heretofore required. The direct aspiration of separated sample component from the separation chamber while the centrifuge drum is still spinning eliminates the separate aspiration chamber required in the first embodiment with no deleterious effects in operation or performance. Moreover, the inclusion of the aspiration apparatus facilitates the back-flushing mode of washing the aspiration line and the separation chamber, and together with the inclusion of the valves in the cavity also allows the heavier components and the wash solution to be discarded even though the drum is still spinning.

Although the invention is generally described in connection with the separation of a blood sample into its heavier components and its lighter plasma component, it will be readily apparent that the methods and apparatus of the present invention are useful in separating other liquid sample mixtures into their lighter and heavier components. Accordingly, no undue limitations should be construed from any description herein of the methods or apparatus of the present invention in connection with the processing of blood samples.

While a particular embodiment of the present invention has been shown and described, it will be obvious to those skilled in the art that various changes and modifications may be made without departing from the invention in its broader aspects. Accordingly, the aim in the appended claims is to cover all such changes and modifications as may fall within the true spirit and scope of the invention.

What is claimed is:

1. Apparatus for separating a sample into its lighter and heavier components comprising:

means including a hollow shaft;

means comprising a centrifuge drum having an interior chamber coupled to the shaft;

means for rotating the shaft about its longitudinal axis to spin the centrifuge drum and cause the heavier components and the lighter components to separate in the interior chamber;

means comprising a vacuum source;

means including a tube extending from the interior centrifuge drum chamber through the hollow shaft;

a seating member mounted on the hollow shaft to rotate therewith;

a stationary coupling member having an orifice therethrough and adapted to be seated on the seating member;

external means coupling the orifice of the stationary coupling member to the vacuum source means; and means comprising a needle-like member mounted on the tube to extend from the rotating hollow shaft through the rotating seating member into the orifice of the stationary coupling member, the separated sample component being aspirated in the tube through the hollow rotating shaft and the needle-like member into the stationary coupling member orifice and therethrough into the external means responsive to the vacuum source means.

2. Apparatus in accordance with claim 1 wherein the vacuum source means comprises a vacuum container.

3. Apparatus in accordance with claim 1 including means for evacuating the remaining components from the interior centrifuge drum chamber.

4. Apparatus in accordance with claim 1 including means for washing the interior centrifuge drum chamber and the means interconnecting the vacuum source means and the interior centrifuge drum chamber after the separated sample component has been aspirated from the centrifuge drum, the interconnecting means including the tube means, the stationary coupling member orifice, the external coupling means, and the needle-like member means.

5. Apparatus in accordance with claim 1 wherein the seating member has a surface with one or more concentric grooves therein on which the stationary coupling member is seated and slides and wherein a lubricant is located between the grooved seating member surface and the stationary coupling member to provide a relatively frictionless surface rotating under the stationary coupling member.

6. Apparatus in accordance with claim 1 wherein the stationary coupling member comprises a low friction material to reduce the friction between the needle-like member and the stationary coupling member orifice and between the rotating seating member and the stationary coupling member.

7. Apparatus in accordance with claim 6 wherein the stationary coupling member material is Teflon.

8. Apparatus in accordance with claim 1 wherein the tube means, the stationary coupling member orifice, the external coupling means and the needle-like member means comprise means interconnecting the interior centrifuge drum chamber and the vacuum source means, wherein the external means includes a needle at the end thereof and wherein the vacuum source means comprises a vacuum container having a stopper and including means for selectively causing the needle to pierce the stopper, the vacuum container evacuating the interconnecting means when the needle is in the vacuum container to aspirate at least a portion of the separated sample component from the interior centrifuge drum into the vacuum container.

9. Apparatus in accordance with claim 8 including means for washing the interconnecting means and the interior centrifuge drum chamber after the sample component has been aspirated into the vacuum container comprising a closed vessel having an aperture therein and a washing liquid inlet and an air inlet for selectively coupling a washing liquid and air into the vessel and including means for inserting the needle of the external tubular means into the washing liquid in the vessel through the aperture to make the vessel airtight and wherein the washing means includes means for coupling air into the vessel to force the washing liquid into the needle to backflush the interconnecting means and the interior centrifuge drum chamber.

10. Apparatus for separating a sample mixture into its lighter and heavier components comprising:

means including a centrifuge drum having an interior chamber having a bottom end wall and a truncated conical interior side wall, the interior side wall having an outwardly extending cavity therein ringing the interior side wall adjacent the bottom end wall, the cavity being at least partly defined by an inner wall and an outer wall and extending upwardly behind the interior side wall;

means for spinning the centrifuge drum to force the heavier components into the cavity;

means for aspirating at least one of the separated components from the centrifuge drum while the centrifuge drum is spinning;

means for evacuating the remaining component from the centrifuge drum, the evacuating means comprising valve means coupling the cavity to outside the centrifuge drum; and actuating means for selectively opening the valve means to allow the remaining components to pass from the cavity to the outside through the valve means.

11. Apparatus in accordance with claim 10 including means enclosing the centrifuge drum means and the evacuating means for collecting the remaining components evacuated from the centrifuge drum by the evacuating means.

12. Apparatus in accordance with claim 10 wherein the spinning means includes a shaft coupled to the centrifuge drum and means for rotating the shaft to spin the centrifuge drum and wherein the valve actuating means comprises means rotating with the shaft and slidable thereon to engage and open the valve means and means coupled to the rotating means for selectively moving the rotating means along the shaft to engage the valve means.

13. Apparatus in accordance with claim 12 including means for biasing the rotating means to be normally away from the valve means.

14. Apparatus in accordance with claim 13 wherein the rotating means includes arm means extending outwardly from the shaft and aligned with the valve means and first ring means encircling the shaft and mounting the arms on the shaft to be rotatable therewith, wherein the moving means comprises second ring means which is stationary with respect to the rotating shaft and movable along the shaft, and including bearing means between the first ring means and the second ring means allowing the first ring means to rotate with the shaft while the second ring means is selectively moved to push the bearing means and the first ring means along the shaft to engage the valve means.

15. Apparatus in accordance with claim 14 wherein the moving means includes pivoted yoke means coupled at one end to the second ring means and pneumatic means coupled to the other end of the pivoted yoke means, the pivoted yoke means translating the forces applied to the other end by the pneumatic means to the end coupled to the second ring means to move the second ring means along the shaft.

16. Apparatus in accordance with claim 12 wherein the rotating shaft is hollow and wherein the aspiration means comprises a vacuum source means and means interconnecting the interior centrifuge drum chamber and the vacuum source through the hollow shaft for aspirating one of the separated components from the centrifuge drum.

17. Apparatus in accordance with claim 16 wherein the interconnecting means comprises tubular aspiration means extending from the interior chamber of the centrifuge drum through the hollow shaft and means for coupling the aspirated sample component from the tubular aspiration means in the rotating hollow shaft to the vacuum source means.

18. Apparatus in accordance with claim 17 wherein the vacuum source means comprises a vacuum container.

19. Apparatus for separating a sample into its lighter and heavier components comprising:

means including a hollow shaft;

means comprising a centrifuge drum mounted on the shaft, the centrifuge drum having an interior chamber having a bottom end wall and a truncated conical interior side wall having an outwardly extending cavity therein ringing the interior side wall adjacent the bottom end wall, the cavity being at least partly defined by an inner wall and an outer wall extending upwardly behind the interior side wall;

means for rotating the shaft about its longitudinal axis to spin the centrifuge drum and force the heavier components into the cavity;

means comprising a vacuum source;

means including a tube extending from the interior centifuge drum chamber through the hollow shaft;

a seating member mounted on the hollow shaft to rotate therewith;

a stationary coupling member having an orifice therethrough and adapted to be seated on the seating member;

external means coupling the orifice of the stationary coupling member to the vacuum source means; and means comprising a needle-like member mounted on the tube to extend from the rotating hollow shaft through the rotating seating member into the orifice of the stationary coupling member, the separated sample component being aspirated in the tube through the hollow rotating shaft and the needle-like member into the stationary coupling member orifice and therethrough into the external means responsive to the vacuum source means.

20. Apparatus in accordance with claim 19 wherein the vacuum source means comprises a vacuum container.

21. Apparatus in accordance with claim 19 wherein the seating member has a surface with one or more concentric grooves therein on which the stationary coupling member is seated and slides and wherein a lubricant is located between the grooved seating member surface and the stationary coupling member to provide a relatively frictionless surface rotating under the stationary coupling member.

22. Apparatus in accordance with claim 19 wherein the stationary coupling member comprises a low friction material to reduce the friction between the needle-like member and the stationary coupling orifice and between the rotating seating member and the stationary coupling member.

23. Apparatus in accordance with claim 19 wherein the tube means, the stationary coupling member orifice, the external coupling means and the needle-like member means comprise means interconnecting the interior centrifuge drum chamber and the vacuum source means, wherein the external coupling means includes a needle at the end thereof and wherein the vacuum source means comprises a vacuum container having a stopper and including means for selectively causing the needle to pierce the stopper, the vacuum container evacuating the interconnecting means when the needle is in the vacuum container to aspirate at least a portion of the separated sample component from the centrifuge drum into the vacuum container.

24. Apparatus in accordance with claim 23 including means for washing the interconnecting means and the interior centrifuge drum chamber after the sample component has been aspirated into the vacuum container comprising a closed vessel having an aperture therein and a washing liquid inlet and an air inlet for selectively coupling a washing liquid and air into the vessel and including means for inserting the needle of the external tubular means into the washing liquid in the vessel through the aperture to make the vessel airtight and wherein the washing means includes means for coupling air into the vessel to force the washing liquid into the needle to backflush the interconnecting means and the interior centrifuge drum chamber.

25. Apparatus for loading a sample into a centrifuge drum through an aperture in the bottom end wall of the drum comprising:

means including a sample container;

means for loading the sample into the sample container at an initial position;

means for transporting the sample container means between the initial position and a loading position directly below the centrifuge drum;

means for vertically repositioning the sample container means to move the sample container means into juxtaposition with the centrifuge drum so that the sample container means engages and communicates with the aperture in the bottom end wall of the centrifuge drum; and means for spinning the centrifuge drum and the sample container means about a common longitudinal axis to cause the sample to flow from the sample container means into the centrifuge drum through the aperture.

26. Apparatus in accordance with claim 25 including a tube for initially containing the sample to be loaded into the centrifuge drum and wherein the sample container means includes means for holding the sample containing tube therein.

27. Apparatus in accordance with claim 26 including means for ejecting the tube from the tube holding means after the sample has been loaded from the tube into the centrifuge drum.

28. Apparatus in accordance with claim 26 wherein the means for loading the sample into the sample container at an initial position comprises plate means having an aperture therein positioned directly over the tube holding means of the sample container means at the initial position of the sample container means and conveyor means for transporting a plurality of the sample containing tubes supported by the plate means to the aperture, the sample containing tubes sequentially falling through the aperture into the tube holding means in the sample container means.

29. Apparatus in accordance with claim 28 including means for aligning the tube holding means with the aperture in the plate means at the initial position of the sample container means.

30. Apparatus in accordance with claim 29 wherein the sample container means comprises a cylindrical block and the tube holding means comprises at least one hole in the cylindrical block and wherein the aligning means comprises an O-ring encircling the cylindrical block, rail means engaging the O-ring to turn the cylindrical block as the sample container means is returned from the loading position to the initial position, and means protruding from the cylindrical block to engage the rail means and prevent the cylindrical block from rotating further before the initial position is reached so that the cylindrical block is aligned with the aperture in the plate means at the initial position.

31. Apparatus in accordance with claim 25 wherein the transporting means includes a platform and means for rotatably supporting the sample cup on the platform.

32. Apparatus in accordance with claim 31 wherein the rotatable supporting means comprises a shaft and wherein the vertical repositioning means comprises a cylinder housing mounted on the bottom of the platform in alignment with the shaft, means in the housing for seating the other end of the shaft, piston means below the seating means, means for selectively introducing compressed air into the housing to reposition the piston means and the seating means in the cylinder housing and bearing means between the seating means and the piston means to support the seating means on the piston means and permit the seating means to rotate with the shaft.

33. Apparatus in accordance with claim 31 wherein the transporting means includes a rail means for slidably supporting the platform and a rack gear attached to the platform and a motor-driven pinion gear engaging the rack gear to transport the platform along the rail means.

34. Apparatus for loading a sample from a sample container into a centrifuge drum having a bottom end wall having an aperture therein aligned with the top end of the sample container and separating the sample into its lighter and heavier components, the apparatus comprising:

means for moving the sample container and the centrifuge drum into juxtaposition so that the top end of the sample container communicates with the aperture in the bottom end wall of the centrifuge drum;

means for spinning the centrifuge drum and the sample container about a common longitudinal axis to cause the sample to flow from the sample container into the centrifuge drum through the aperture and separate into the heavier components and the lighter components in the centrifuge drum; and means for aspirating at least one of the separated components from the centrifuge drum while the centrifuge drum is spinning.

35. A method of loading a sample from a sample container into a centrifuge drum having a bottom end wall having an aperture therein aligned with the open top end of the sample container and separating the sample into its lighter and heavier components, the method comprising:

moving the sample container and the centrifuge drum into juxtaposition so that the top end of the sample container communicates with the aperture in the bottom end wall of the centrifuge drum;

spinning the centrifuge drum and the sample container about a common longitudinal axis to cause the sample to flow from the sample container into the centrifuge drum through the aperture, the spinning further causing the heavier components and the lighter components to separate in the centrifuge drum; and aspirating one or both of the separated components from the centrifuge drum while the centrifuge drum is spinning.

36. An automatic sample processing apparatus comprising:

means comprising a rotating support means and a plurality of centrifuge apparatus mounted on the rotating support means, each centrifuge apparatus comprising a centrifuge drum and means for spinning the drum to separate the sample into its lighter and heavier components;

means rotating in synchronization with the rotating centrifuge apparatus support means for transporting a plurality of samples to an initial position;

means for sequentially loading each of the samples from the transporting means into corresponding ones of the centrifuge drums, the loading means receiving the sample from the transporting means at the initial position, transporting the sample to a loading position, and loading the sample into the centrifuge drum;

means associated with each of the centrifuge apparatus comprising aspiration means coupled to interior of the centrifuge drum;

means comprising a plurality of vacuum containers rotating in synchronization with the rotating centrifuge apparatus support means for aligning the aspiration means associated with a particular one of the centrifuge apparatus with a corresponding one of the vacuum containers at an aspiration position; and means for inserting the aspiration means into the vacuum container at the aspiration position to aspirate one of the separated sample components from the centrifuge drum while the centrifuge drum is spinning.

37. Apparatus in accordance with claim 36 including means for washing the centrifuge drums after the separated sample component has been aspirated therefrom, the washing means comprising a vessel containing a washing liquid positioned adjacent the rotating centrifuge apparatus support means at a position after the aspiration position where the inserting means inserts the aspiration means into the vessel and including means for forcing air into the vessel to backflush wash liquid through the aspiration means into the centrifuge drum to wash the remaining sample components from the aspiration means and the centrifuge drum.

38. A method of loading a sample from a sample container into a centrifuge drum having a bottom end wall having an aperture therein aligned with the open top end of the sample container and separating the sample into its lighter and heavier components, the method comprising:

moving the sample container and the centrifuge drum into juxtaposition so that the open top end of the sample container communicates with the aperture in the bottom end wall of the centrifuge drum;

spinning the centrifuge drum and the sample container about a common longitudinal axis to cause the sample to flow from the sample container into the centrifuge drum through the aperture, the spinning further causing the heavier components and the lighter components to separate in the centrifuge drum; and removing one or both of the separated components from the centrifuge drum.

39. A method of loading a sample from a sample container into a centrifuge drum and separating the sample into its lighter and heavier components, the centrifuge drum having a conical interior side wall with a trap means comprising a cavity in the side wall ringing the interior side wall and further having a bottom end wall having an aperture therein aligned with the open top end of the sample container, the method comprising:

moving the sample container and the centrifuge drum into juxtaposition so that the open top end of the sample container communicates with the aperture in the bottom end wall of the centrifuge drum;

spinning the centrifuge drum and the sample container about a common longitudinal axis to cause the sample to flow from the sample container into the centrifuge drum through the aperture;

the spinning further causing the heavier components to be forced into the cavity while the lighter components are forced up the conical interior side wall; and removing one or both of the separated components from the centrifuge drum.

40. Apparatus for loading a sample from a sample container into a centrifuge drum having a bottom end wall having an aperture therein aligned with the open top end of the sample container and separating the sample into its lighter and heavier components, the apparatus comprising:

means for moving the sample container and the centrifuge drum into juxtaposition so that the open top end of the sample container communicates with the aperture in the bottom end wall of the centrifuge drum;

means for spinning the centrifuge drum and the sample container about a common longitudinal axis to cause the sample to flow from the sample container into the centrifuge drum through the aperture and separate into the heavier components and the lighter components in the centrifuge drum; and means for removing one or both of the separated components from the centrifuge drum.

41. Apparatus for loading a sample from a sample container into a centrifuge drum and separating the sample into its lighter and heavier components, the centrifuge drum having a conical interior side wall with a trap means comprising a cavity in the side wall ringing the interior side wall and further having a bottom end wall having an aperture therein aligned with the open top end of the sample container, the apparatus comprising:

means for moving the sample container and the centrifuge drum into juxtaposition so that the open top end of the sample container communicates with the aperture in the bottom end wall of the centrifuge drum;

means for spinning the centrifuge drum and the sample container about a common longitudinal axis to cause the sample to flow from the sample container into the centrifuge drum through the aperture and to further cause the heavier components to be forced into the cavity while the lighter components are forced up the conical interior said wall; and means removing one or both of the separated components from the centrifuge drum.

* * * * *